United States Patent [19]

Amato

[11] 4,233,699

[45] Nov. 18, 1980

[54] PORTABLE SECURITY WALL

[76] Inventor: Michael G. Amato, 1306 Turner Ave., Wanamassa, N.J. 07712

[21] Appl. No.: 966,147

[22] Filed: Dec. 4, 1978

[51] Int. Cl.[2] ..... A47C 21/08

[52] U.S. Cl. ..... 5/426; 5/513

[58] Field of Search ..... 5/94, 425, 426, 443, 5/512, 513; 248/359, 460, 461, 478

[56] References Cited

U.S. PATENT DOCUMENTS

| | | | |
|---|---|---|---|
| 2,611,909 | 9/1952 | Dillon et al. | 5/426 |
| 2,686,922 | 8/1954 | La Vigne | 5/513 |
| 3,063,064 | 11/1962 | Mace | 5/94 |

*Primary Examiner*—Casmir A. Nunberg

*Attorney, Agent, or Firm*—Charles I. Brodsky

[57] ABSTRACT

A portable security wall incorporating a first section, insertable beneath a chair cushion, couch cushion, mattress, or the like, on which an infant may be placed, and a second section, angularly disposed with respect thereto, to serve as a backstop to prevent the infant from falling.

5 Claims, 3 Drawing Figures

PORTABLE SECURITY WALL

FIELD OF THE INVENTION

This invention relates to a security wall for preventing an infant or child from falling from a chair, couch, mattess, or the like, and, more particularly, to one which is portable in nature and which offers see-through capabilities.

BACKGROUND OF THE INVENTION

As is well known and understood, one of the problems faced by parents of new-born babies and other infants is what to do with the child in the homes of people whom the parents are visiting. As will be appreciated, baby carriages, cannot easily be packed in a motor vehicle to be taken along, and collapsible playpens are oftentimes cumbersome, both in their transportation, and in their setting up. Rather than sit around holding the baby or infant in her arms, the new mother often rests the baby on a chair, couch or mattress, and then props a chair alongside in an attempt to prevent the child from falling off as he or she rolls about. One problem in such a situation is that the chair frequently blocks the baby from view, so that it cannot be easily determined from across the room just what the baby is doing, or whether it is in physical discomfit, or whether it is alright. Another problem with such a setup is that the chair used as a prop frequently does not have a right angled back, and, depending upon where the chair prop makes contact with the couch, mattress, etc., a clear space might exist through which the child could roll and fall. A more protective security arrangement is therefore desirable, and, furthermore, one which can easily be carried about.

SUMMARY OF THE INVENTION

As will become clear hereinafter, the security wall of the present invention, in a preferred embodiment, is constructed of a clear-plastic material to be both light in weight and easy to see through. One section is adapted to be inserted under the cushion or mattress, on which the child is placed, and a second section is disposed at substantially a right-angle in providing a protective enclosure. Should the baby or infant then roll in a direction off the cushion or mattress, the protective section would act as a backstop to prevent further movement. As will be seen, the dimensions selected for the two sections cooperate in a direction to add sturdiness to the construction, and to be able to sustain the weights and forces expected. With the specific dimensioning discussed below, weights of up to 175 pounds have been supported by the backstop, which, therefore, makes the security wall of the present invention adaptable not only for usage with new-born babies and infants, but with adults as well, as in a hospital environment.

BRIEF DESCRIPTION OF THE DRAWING

These and other features of the present invention will be more readily understood from a consideration of the following description taken in connection with the accompanying drawing in which.

DETAILED DESCRIPTION OF THE DRAWING

Figure 1:
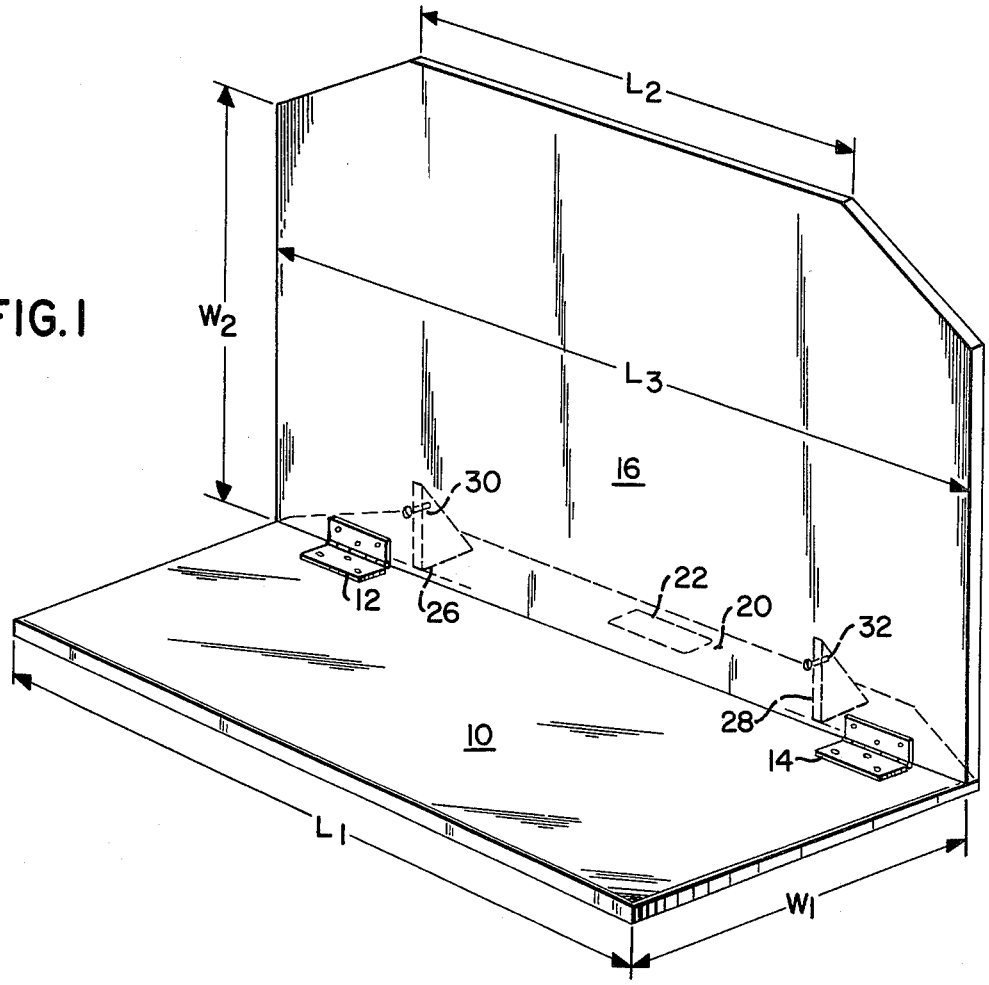
FIG. 1 is a perspective view of a security wall constructed in accordance with the invention, as it would appear in its open condition.

Referring to the drawing, the security wall of the invention will be understood as being constructed of a clear plastic material typically of a one quarter inch thickness. A first section 10 is of rectangular construction, with a width $W_1$ and a length $L_1$. Secured to the section 10, as by a pair of right-angle hinges 12, 14 is a second section 16, also generally rectangular, having lengths $L_2$, $L_3$, as indicated, and a width $W_2$. As will be apparent, the hinges 12, 14 serve to maintain the sections 10, 16 in substantially perpendicular relationship.

Figure 2:
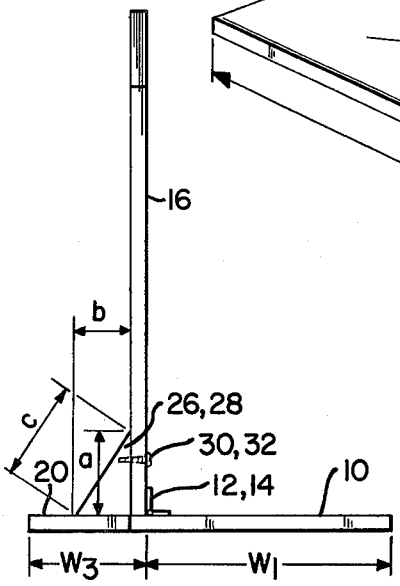
FIG. 2 is a side view of the security wall of the invention.
Figure 3:
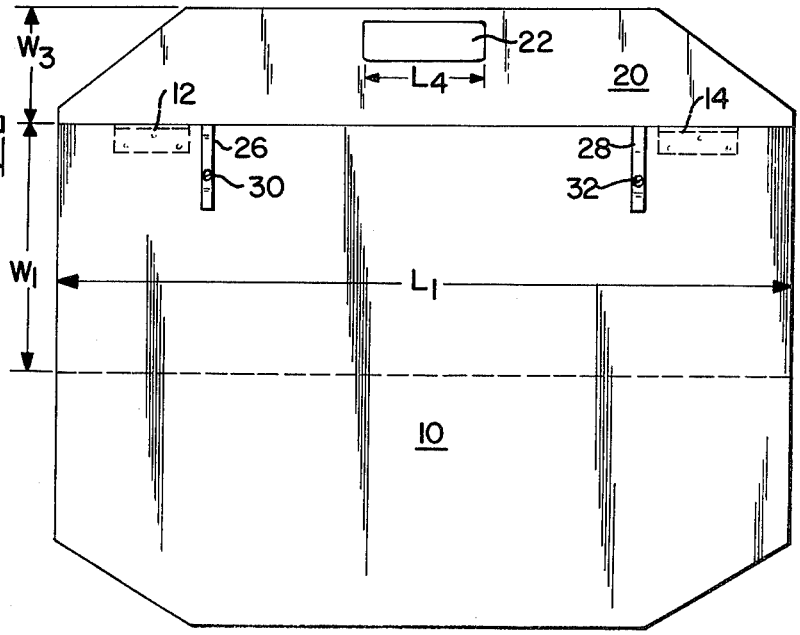
FIG. 3 shows the security wall in its collapsed condition, ready for easy carrying about.

As is more clearly shown in FIG. 2, the first section 10 is fashioned from a single piece of clear plastic material which extends rearwardly of the section 16 by a further width $W_3$. Situated in the center, or central region, of such additional extension 20 is an aperture 22 to be grasped in carrying the security wall, when in collapsed condition. The length of such aperture is shown as $L_4$. Although the hinges 12, 14 are effective in maintaining the section 16 substantially at right angles to the section 10, a pair of backstops 26, 28 are further incorporated, being secured to the rear of the section 16 by means of screw or other type fasteners 30, 32, seated atop the extension 20 in triangular support to limit further any tendency of the section 16 to rearward movement. The triangular dimensions for the backstop 26 are shown as $a_1$, $b_1$, $c_1$ in FIG. 2.

In usage of the invention, the first section 10 is inserted under the cushion of a chair, couch or mattress, and the section 16 rotated clockwise (FIG. 2) to an upright position. Further movement of the section 16 will be seen to be prevented by the hinges 12, 14 and by the backstops 26, 28, which rotate along with the section 16 until stopped by the extension 20 acting as a limit surface. The baby or infant can then be placed on the cushion or mattress, with its weight and that of the cushion, or mattress, serving to hold the security wall thus formed in place. After usage, the construction can be removed from the chair, couch or bed, and the upright section 16 then rotated counter-clockwise to a collapsed position, such that the security wall could be drawn away merely by pulling on the aperture 22.

In one construction of the invention, the following dimensions were employed:

Length $L_1$—26 inches
Length $L_2$—17 inches
$L_3$—26 inches
Length $L_4$—5 inches
Width $W_1$—$10\frac{3}{4}$ inches
Width $W_2$—16 inches
Width $W_3$—$2\frac{1}{4}$ inches
Dimension a—$2\frac{1}{2}$ inches
Dimension b—2 inches
Dimension c—3 inches With clear plastic used as the material for the sections 10, 16, 20 so that the security wall would be of a see-through nature, and of $\frac{1}{4}$ inch thickness, the portable security wall could be folded to a thickness of $1\frac{1}{4}$ inches, and have an overall weight of some 5 pounds. As will be apparent, modifications may be made in these dimensions where the security wall is intended for use other than with babies or infants, such as in a hospital bed environment, where adult usage is desired. There, the lengths and widths indicated above might be varied, but the dimensions for the backstops 26, 28—used for added safety should the hinges 12, 14, become unbuckled—could remain the same.

While there has been described what is considered to be a preferred embodiment of the present invention, it will be readily appreciated by those skilled in the art that modifications may be made without departing from the scope of the teachings herein. For such reason, resort should be had to the claims appended hereto for a true understanding of the scope of the invention.

I claim:

1. A portable security wall for infants, children, invalids, and the like, comprising:

a first, generally rectangular section for insertion beneath a chair cushion, a couch cushion, a mattress, etc., onto which the infant, child, or invalid is to be placed; and a second, generally rectangular section rotatable with respect to said first section, to be substantially perpendicular therewith when intended for use in preventing such persons from falling from said chair, couch, mattress, etc. and to be substantially parallel therewith when put away and not intended for use with such persons;

wherein said second, generally rectangular section is positioned along a length of said first, generally rextangular section intermediate the ends thereof, and wherein there is also included first means affixed to each of said first and second sections to control the rotation of said sections with respect to each other to substantially ninety degrees;

wherein said included first means comprise a pair of right angled hinges, each of which is secured at one side of said first and second sections proximate the ends thereof;

wherein there is additionally included second means affixed to said second, generally rectangular section, to be rotatable therewith, and to further control the rotation of said second section with respect to said first section to substantially ninety degrees; and wherein said additionally included second means comprise a pair of backstops, each of which is secured on a side of said second section opposite from the said to which said hinges are secured, to bear against said first section when said second section is rotated for use, to thereby limit the rotation of said second section to ninety degrees.

2. The portable security wall of claim 1 wherein said hinges are positioned to control said second, generally rectangular section to lie substantially along said first, generally rectangular section when said security wall is to be put away and not intended for use.

3. The portable security wall of claim 1 wherein handle means are provided said first, generally rectangular section, to permit the easy carrying about of said first and second sections when the security wall is not intended for use.

4. The portable security wall of claim 1 wherein said first and second sections are manufactured of a see-through plastic material.

5. The portable security wall of claim 1 wherein said first and second sections are manufactured of clear plastic material.

* * * * *